US007426784B2

(12) United States Patent
Spears et al.

(10) Patent No.: US 7,426,784 B2
(45) Date of Patent: Sep. 23, 2008

(54) COMPACT FIRE SPRINKLER ATTACHMENT INSERT

(75) Inventors: Wayne Spears, Sylmar, CA (US); Douglas Swingley, Savgus, CA (US)

(73) Assignee: Spears Manufacturing Co., Sylmar, CA (US)

( * ) Notice: Subject to any disclaimer, the term of this patent is extended or adjusted under 35 U.S.C. 154(b) by 246 days.

(21) Appl. No.: 11/227,859

(22) Filed: Sep. 14, 2005

(65) Prior Publication Data

US 2007/0056751 A1 Mar. 15, 2007

(51) Int. Cl.
*B21D 51/16* (2006.01)

(52) U.S. Cl. ..... 29/890.14; 169/16; 169/17; 285/355

(58) Field of Classification Search ..... 169/16, 169/17, 43; 29/890.143; 239/231; 285/355
See application file for complete search history.

(56) References Cited

U.S. PATENT DOCUMENTS 1,681,470 A * 8/1928 Drees ..... 285/64
2,667,933 A * 2/1954 Stack ..... 169/17
3,834,462 A * 9/1974 Orloff et al. ..... 169/17
5,286,001 A * 2/1994 Rafeld ..... 251/366
5,775,378 A * 7/1998 Auvil et al. ..... 138/143
6,540,261 B1 * 4/2003 Painter et al. ..... 285/133.11
2002/0185282 A1 * 12/2002 Kretschmer ..... 169/43
2006/0225895 A1 * 10/2006 Grant ..... 169/16

* cited by examiner

*Primary Examiner*—Len Tran
*Assistant Examiner*—Trevor E. McGraw
(74) *Attorney, Agent, or Firm*—Denton L. Anderson; Sheldon Mak Rose & Anderson PC

(57) ABSTRACT

The invention satisfies this need. The invention is an internally threaded insert for use with a polymetric pipe fitting in a fire sprinkler system. The insert comprises an outer side surface, an outer rearward surface and an outer forward surface. The outer forward surface is adapted to retain a fire sprinkler at a forward end of the insert. The outer side surface of the insert is sized and dimensioned so as to closely match the bores of standard polymeric pipe fittings, so as to be capable of being slidably and snugly received into the bores of a standard polymeric pipe fitting. The insert can be conveniently affixed within the bores by non-mechanical means, such as by gluing.

3 Claims, 9 Drawing Sheets

FIG. 8
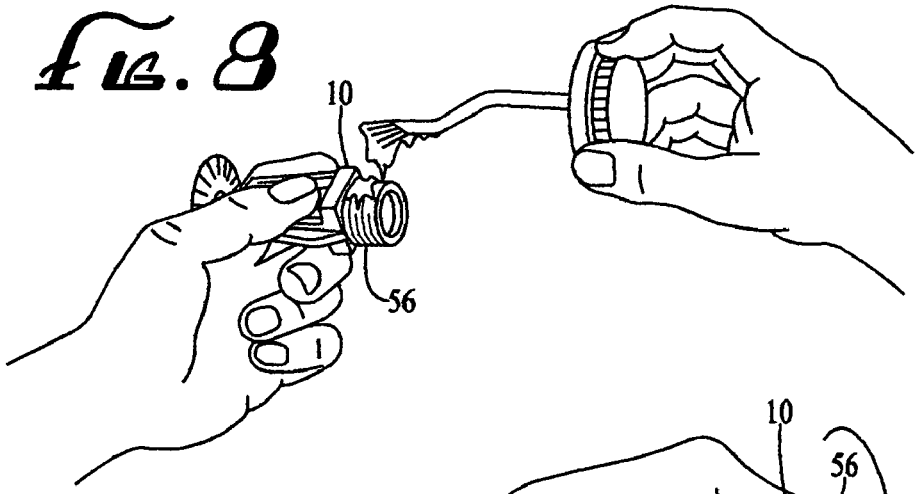
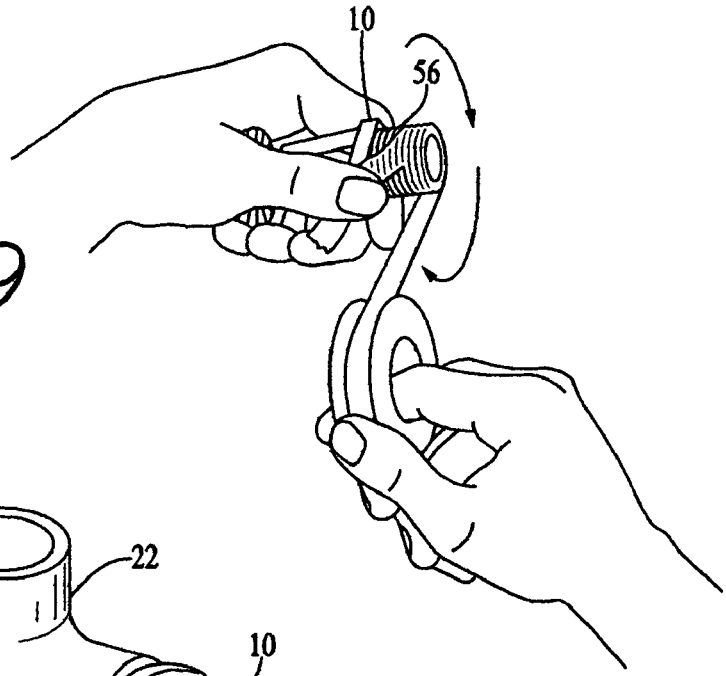
FIG. 9
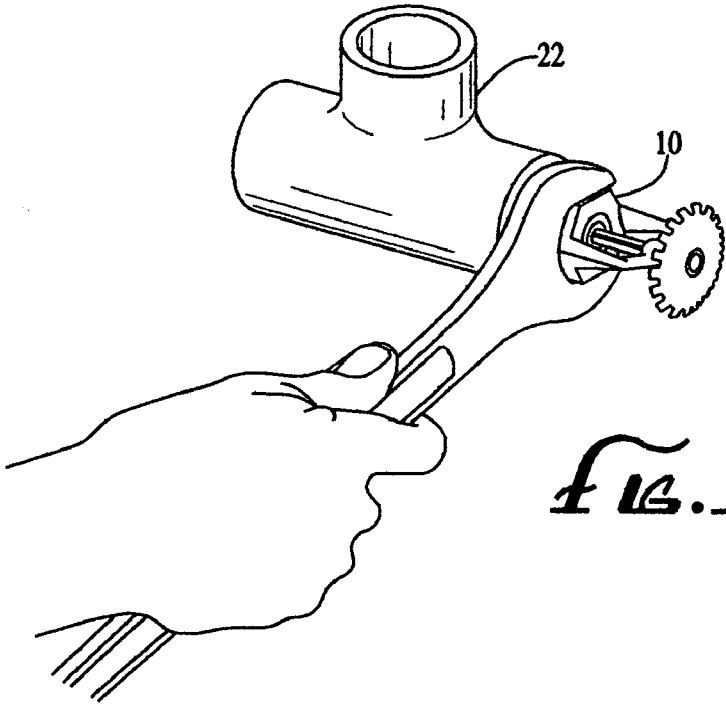
FIG. 10

COMPACT FIRE SPRINKLER ATTACHMENT INSERT

BACKGROUND OF THE INVENTION

Fire sprinkler systems are increasingly recognized as necessary safety features in the construction of new buildings and in the upgrading of existing buildings.

Unfortunately, fire sprinkler systems of the prior art typically require specially designed fittings for attachment of the fire sprinklers to the polymeric pipes carrying the fire sprinkler water. This markedly raises the cost of installing fire sprinkler systems.

Accordingly, there is a need for fire sprinkler attachments which will avoid the aforementioned problems in the prior art.

SUMMARY

The invention satisfies this need. The invention is an internally threaded insert for use with a polymetric pipe fitting in a fire sprinkler system. The insert comprises an outer side surface, an outer rearward surface and an outer forward surface. The outer forward surface is adapted to retain a fire sprinkler at a forward end of the insert. The outer side surface of the insert is sized and dimensioned so as to closely match the bores of standard polymeric pipe fittings, and to be capable of being slidably and snugly received into the bores of a standard polymeric pipe fitting. The insert can be conveniently affixed within the bores by non-mechanical means, such as by gluing.

In other aspects of the invention, the invention is a kit comprising the threaded insert and a standard polymeric pipe fitting, the combination of the threaded insert and a standard polymeric pipe fitting, and a method for installing fire sprinklers using the combination of the threaded insert and a polymeric pipe fitting.

DRAWINGS

These and other features, aspects and advantages of the present invention will become better understood with reference to the following description, appended claims and accompanying drawings where:

FIG. 8 is a perspective view illustrating a first step in the installation of the fire sprinkler illustrated in FIG. 7 into the fire sprinkler piping combination illustrated in FIG. 7;

FIG. 9 is a perspective view illustrating an alternative first step in the installation of the fire sprinkler illustrated in FIG. 7 into the fire sprinkler piping combination illustrated in FIG. 7;

FIG. 16 is a cross-sectional side view illustrating the fire sprinkler piping combination illustrated in FIG. 7, showing both inserts fully disposed within the polymeric piping fitting;

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1:
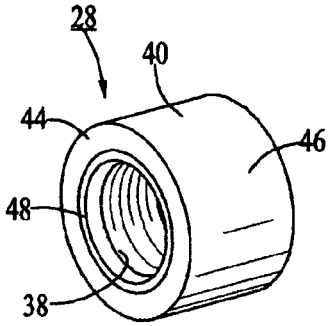
FIG. 1 is a front side perspective view of a threaded insert having features of the invention.
Figure 2:
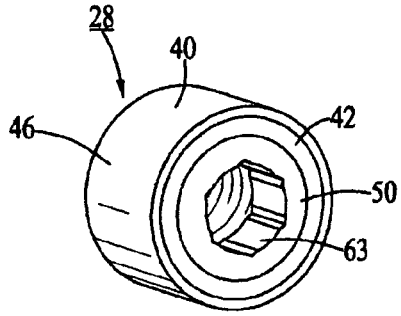
FIG. 2 is a rear side perspective view of the insert illustrated in FIG. 1.

The invention is a threaded insert 28, as illustrated in FIGS. 1 and 2. The threaded insert 28 has a polymeric body 46, interior threads 38, an outer side surface 40, an outer rearward surface 42 and an outer forward surface 44. The interior threads 38 within the outer forward surface 44 are adapted to retain a fire sprinkler 10 at a forward end of the insert 28. Preferably, the interior threads 38 are defined in an internally threaded moiety 48 on the outer forward surface 44.

Also preferably, a non-circular wrench opening moiety 50 is disposed in the outer rearward surface 42. Typically, both the internally threaded moiety 48 and the wrench opening moiety 50 are made of a metal, such as brass.

The outer side surface 40 is smooth and is sized and dimensioned to match the internal bores of standard polymeric pipe fittings. Thus, a very important advantage of the insert 28 of the invention is that virtually any standard polymeric pipe fitting can be used in the installation of a fire sprinkler, 90° fittings, 45° fittings, T's, Y's, double crosses, etc. Another important advantage of the insert 28 is that the resulting combination of the insert 28 and a standard pipe fitting is very compact, needing to be no greater in length than the already existing bore of the standard pipe fitting in which it is installed. However, as will be further described below, the use of the insert 28 allows the installer to lengthwise adjust the combination of the insert 28 and the standard pipe fitting to meet particular installation needs. To provide sufficient length for lengthwise adjustable disposition of each insert 28 within a side branch 26, the distance between the outer forward surface 44 of the insert 28 and the outer rearward surface 42 of the insert 28 is at least about ¾ inch.

Figure 3:
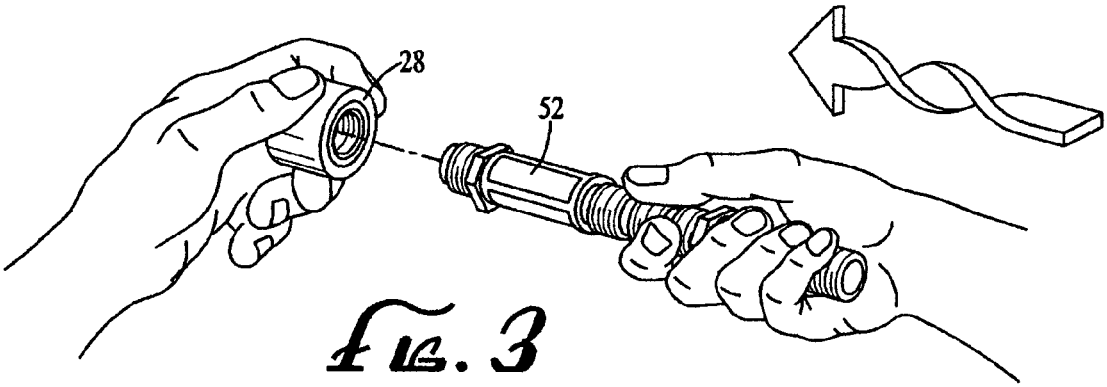
FIG. 3 is a perspective view showing a first step in the assembly of the threaded insert illustrated in FIG. 1 into a polymeric pipe fitting.
Figure 4:
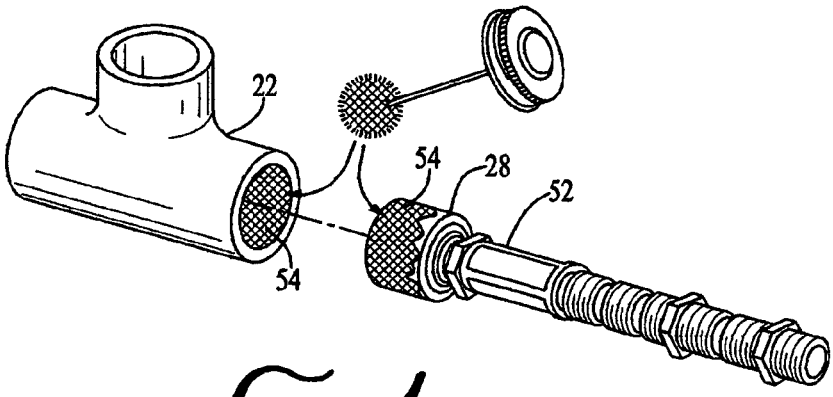
FIG. 4 is a perspective view showing a second step in the assembly of the threaded insert illustrated in FIG. 1 into a polymeric pipe fitting.
Figure 5:
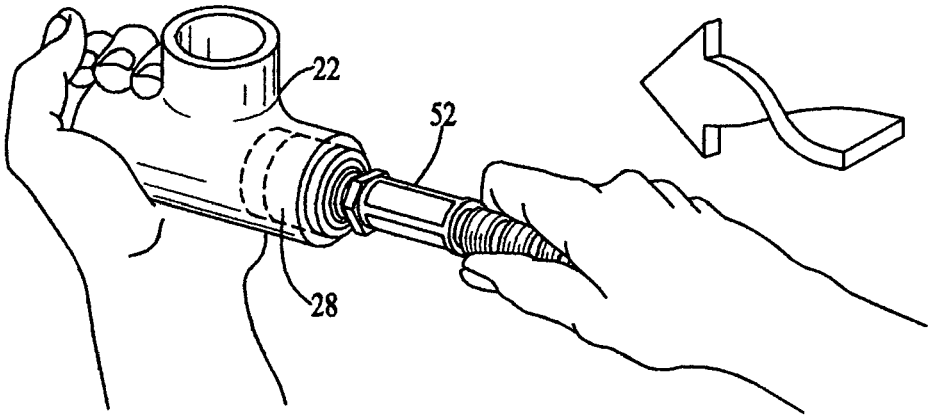
FIG. 5 is a perspective view showing a third step in the assembly of the threaded insert illustrated in FIG. 1 into a polymeric pipe fitting.
Figure 6:
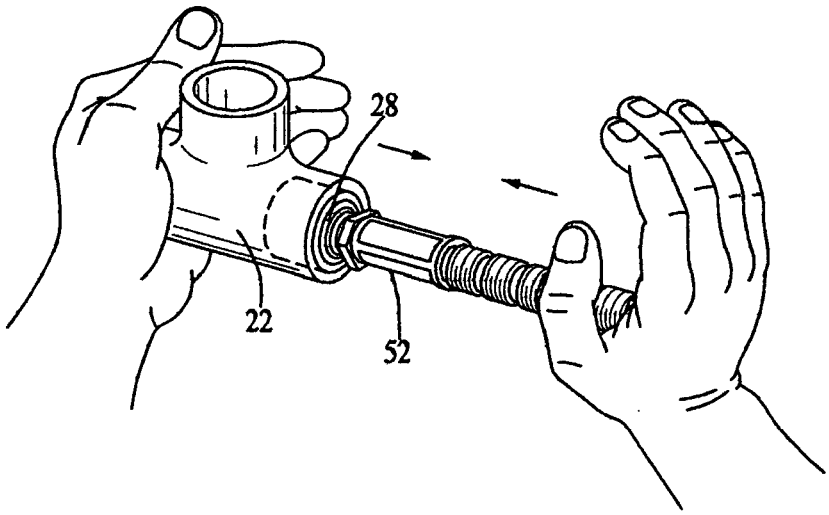
FIG. 6 is a perspective view showing a fourth step in the assembly of the threaded insert illustrated in FIG. 1 into a polymeric pipe fitting.
Figure 7:
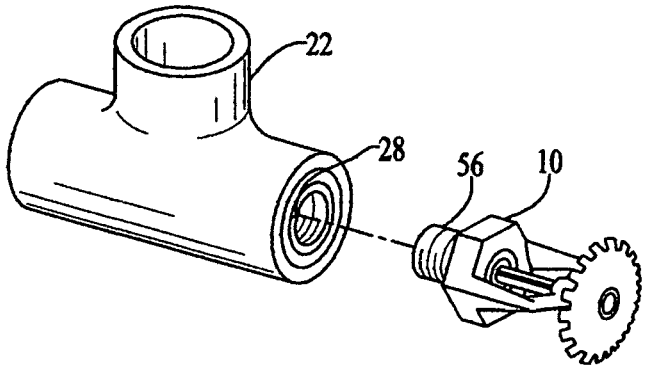
FIG. 7 is a perspective view illustrating a fire sprinkler piping combination and a fire sprinkler having features of the invention.

FIG. 3 illustrates a typical first step in a method of using the insert 28 to install a fire sprinkler. In FIG. 3, an insert 28 is initially threadably attached into a holding tool 52 comprising a short length of pipe having matching external threads. FIG. 4 illustrates a typical subsequent step in the method wherein the insert 28 and the interior surface 16 of one side branch 26 of the polymeric pipe fitting 22 are coated with a suitable adhesive 54. FIG. 5 illustrates another typical step in the method wherein the insert 28 is disposed within a side branch 26 of the polymeric pipe fitting 22. This action can be facilitated by rotating the holding tool 52 about ¼ turn during the insertion of the insert 28 into the side branch 26. FIG. 6 illustrates another typical step in the method wherein the depth of the insert 28 within the side branch 26 is carefully adjusted so that the resultant combination of the polymeric pipe fittings 22 and the pair of inserts 28 matches the distance between the spaced apart, parallel walls 12 where the fire sprinkler fittings 10 are to be installed. FIG. 7 illustrates the intended installation of the fire sprinkler 10 into the combination of a polymeric pipe fitting 22 and an insert 28. FIG. 8 illustrates a typical step in the installation of the fire sprinkler 10 into the internally threaded moiety 48 of the insert 28 wherein the external threads 56 of the fire sprinkler 10 are coated with a suitable pipe sealing compound.

FIG. 9 illustrates an alternative step in preparing the external threads 56 of the fire sprinkler 10 for insertion into the internally threaded moiety 48 of the insert 28, wherein the external threads 56 are wrapped with a suitable sealing tape.

Figure 10:
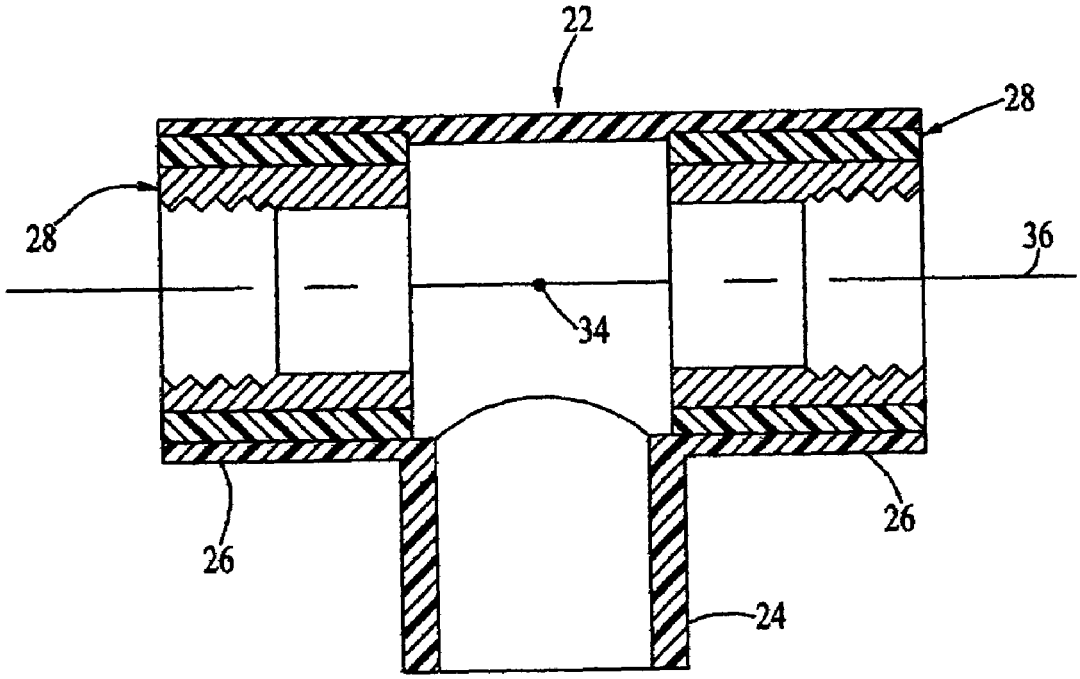
FIG. 10 is a perspective view illustrating a second step in the installation of the fire sprinkler illustrated in FIG. 7 into the fire sprinkler piping combination illustrated in FIG. 7.

FIG. 10 illustrates a typical subsequent step in the method, wherein the fire sprinkler 10 is threaded into the internally threaded moiety 48 of an insert 28 and tightened with a spanner.

Figure 11:
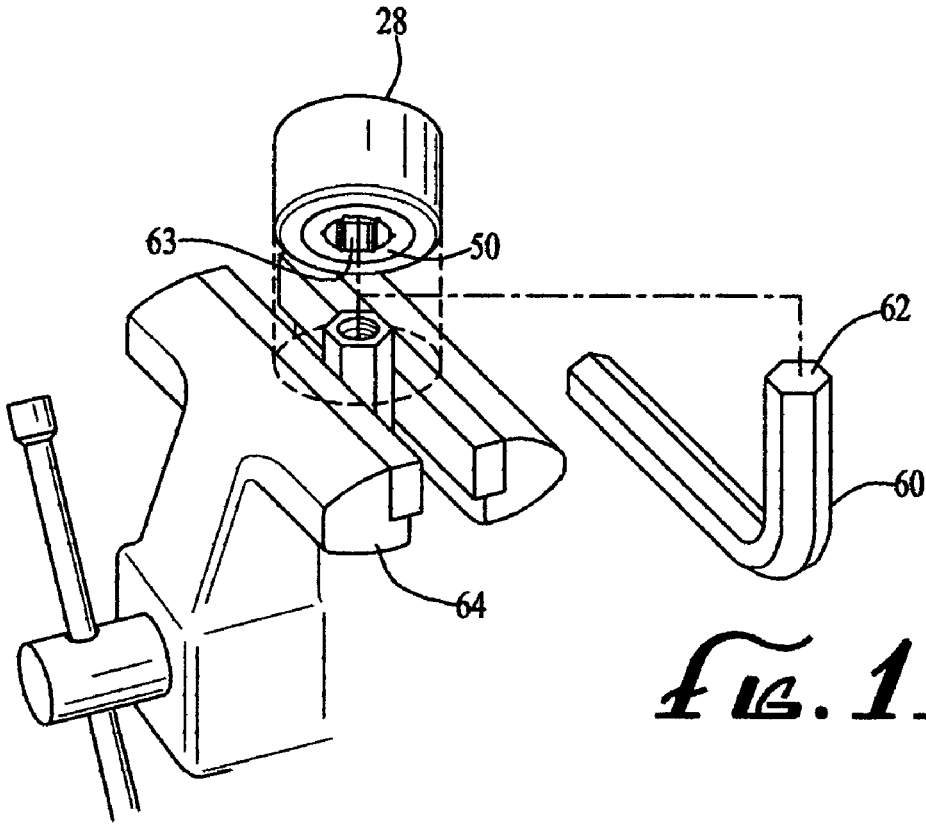
FIG. 11 is a perspective view illustrating a first step in the assembly of a fire sprinkler into the insert illustrated in FIG. 1.
Figure 12:
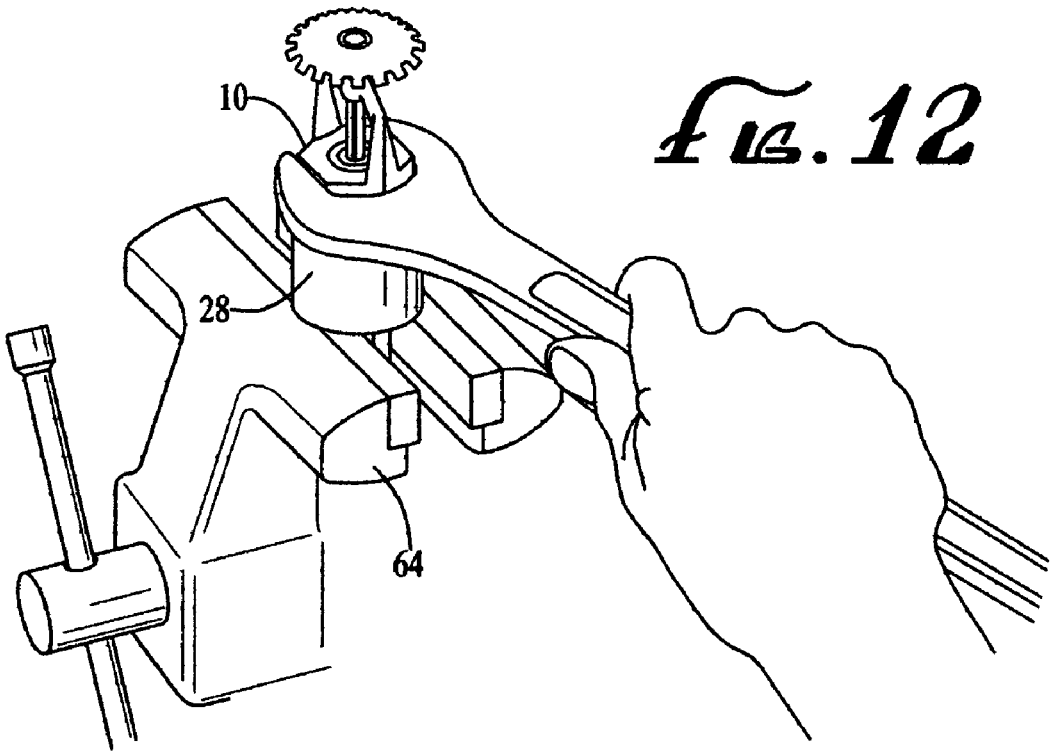
FIG. 12 is a perspective view illustrating a second step in the assembly of a fire sprinkler into the insert illustrated in FIG. 1.
Figure 13:
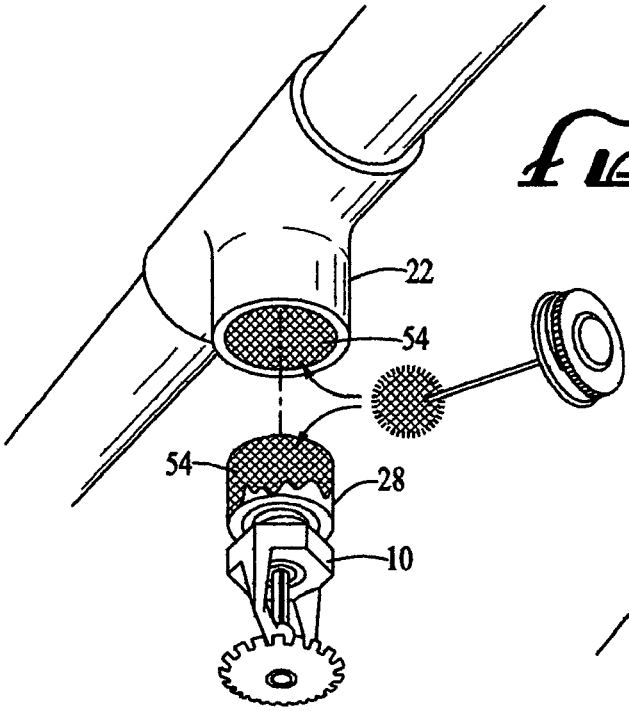
FIG. 13 is a perspective view illustrating a third step in the assembly of a fire sprinkler into the insert illustrated in FIG. 1.
Figure 14:
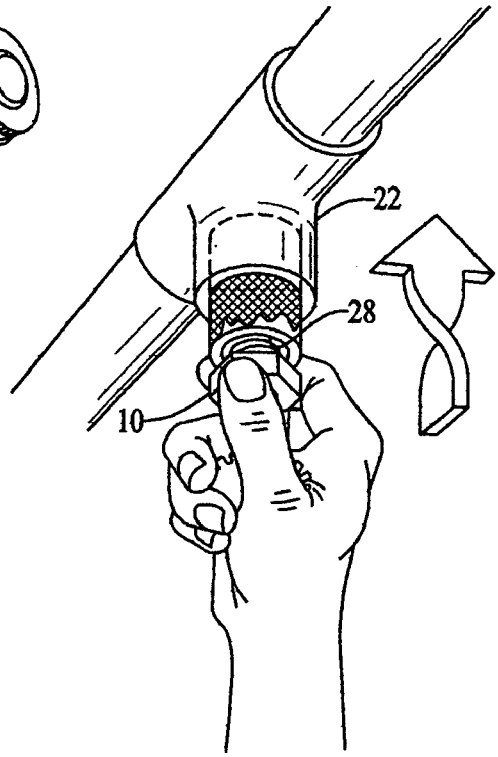
FIG. 14 is a perspective view illustrating a fourth step in the assembly of a fire sprinkler into the insert illustrated in FIG. 1.
Figure 15:
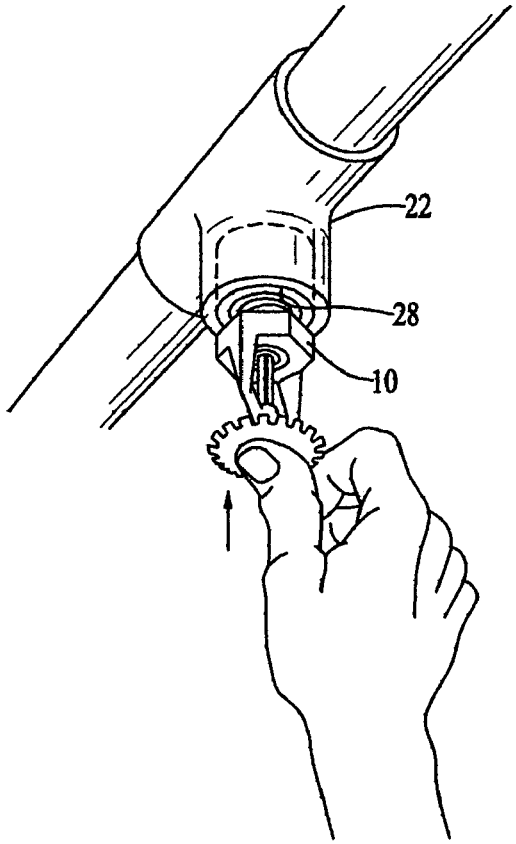
FIG. 15 is a perspective view illustrating a fifth step in the assembly of a fire sprinkler into the insert illustrated in FIG. 1.

FIG. 11 illustrates a typical step in an alternative procedure for using the insert 28 to install a fire sprinkler. In FIG. 11, a wrench 60 having a wrench head 62 which matches a non-circular wrench opening 63 in the outer rearward surface 40 of the insert 28 is rigidly retained within a suitable retaining device 64. In FIG. 11, the retaining device 64 is a common bench vise. FIG. 11 further illustrates the attachment of the insert wrench head 62 into the non-circular wrench opening 63 in the outer rearward surface 42 of the insert 28. FIG. 12 illustrates the installation of a fire sprinkler 10 into the internally threaded moiety 48 of the insert 28 while the insert 28 is rigidly retained on the wrench head 62 of the wrench 60. FIG. 13 illustrates a typical subsequent step in this alternative method, wherein the combination of the fire sprinkler 10 and the insert 28 is prepared for installation into a branch 26 of a polymeric pipe fitting 22 by being coated with a suitable cement. FIG. 14 illustrates the insertion of the insert 28 into the branch 26, typically using a quarter turn of the insert 28 during installation. FIG. 15 illustrates the adjustment of the depth of the insert 28 within the branch 26 of the polymeric pipe fitting 22.

The insert 28 can be used in an improved method for assembling a pair of oppositely disposed fire sprinklers 10 on opposite sides of a pair of spaced apart, parallel walls 12, wherein each wall 12 has an exterior surface 14 and an interior surface 16. The method comprises the steps of (a) disposing a main water header line 18 between the pair of walls 12, (b) disposing at a distal end 20 of the main water header line 18 a polymeric pipe fitting 22 having a main branch 24 and at least a first tubular side branch 26 on a second tubular side branch 26, (c) disposing an internally threaded insert 28 within each of the side branches 26 while adjusting the depth of each insert 28 within its side branch 26, such that the outer forward surface 44 of each insert 28 is disposed proximate to the interior surface 16 of one of the pair of side walls 12, (d) retaining each insert 28 within a side branch 26 by non-mechanical means, and (e) attaching a fire sprinkler 10 to each of the inserts 28, such that a deflector 32 of each respective sprinkler 10 projects from the exterior surface 14 of each of the spaced apart walls 12.

In a typical embodiment of this method, the pair of spaced apart, parallel walls 12 are separated from each other by a distance between about 3 inches and about 4 ½ inches. Typically, the exterior surface 14 of each of the pair of spaced apart parallel walls 12 faces outwardly into a separate room or separate space within a single room.

Typically, the main water header line 18 is made from polymeric pipe and has a nominal diameter between about ¾ inches and about 1½ inches.

The polymeric pipe fitting 22 can also be a tee fitting, such as illustrated in the drawings, but other fitting types can also be used. Each of the side branches 26 in the polymeric pipe fitting 22 extends outwardly from a common junction 34 along a common axis 36. The side branches 26 are co-linear and the main branch 24 is generally perpendicular to the side branches 26. Each of the branches 24 and 26 has a distal end opposite from the common junction 34. The distal ends of each of the side branches 26 have a smooth internal surface bore and the distal end of the main branch 24 has a smooth internal main bore, allowing it to be slidably received over the smooth outer end of the length of pipe.

The outer side surface 40 of each of the inserts is sized and dimensioned so as to closely match the side bores in the side branches 26 of the polymeric pipe fitting 22 and so as to be capable of being slidably and snugly received into one of the side bores at any of a plurality of locations along the common axis 36, such that, when the pipe fitting 22 is disposed within the spaced apart walls 12, a deflector 32 of each respective sprinkler 10 projects from an exterior surface 14 of one of the walls 12 opposite an interior surface 16 exposed to the pipe fitting 22.

FIG. 16 is a cross-sectional side view of a typical polymeric pipe fitting 22 showing a pair of opposed inserts 28 fully disposed within the side branches 26 of the polymeric pipe fitting 22.

Figure 17:
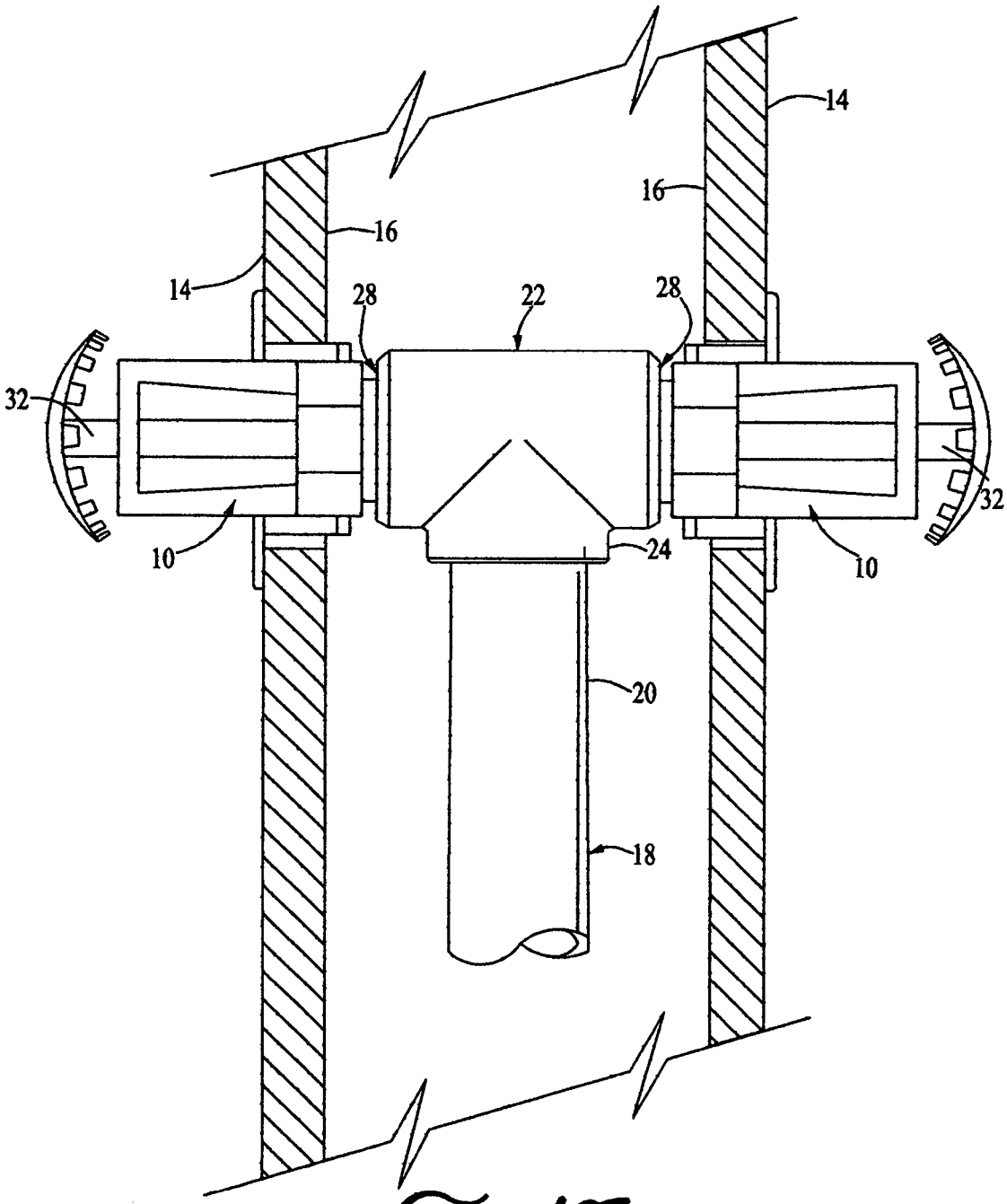
FIG. 17 is a cross-sectional side view illustrating the installation of the fire sprinkler piping combination illustrated in FIG. 16 installed between a pair of parallel, spaced apart walls.

FIG. 17 illustrates a typical use of the inserts 28 and polymeric pipe fitting combination 22 of the invention to install a pair of opposed fire sprinklers 10 on opposite sides of a pair of parallel, spaced apart walls 12. The distance between the pair of parallel, spaced apart walls 12 in FIG. 17 is relatively narrow, so that proper installation is achieved by fully disposing both inserts 28 into the side branches 26 of the polymeric pipe fitting 22 (as illustrated in FIG. 16).

Figure 18:
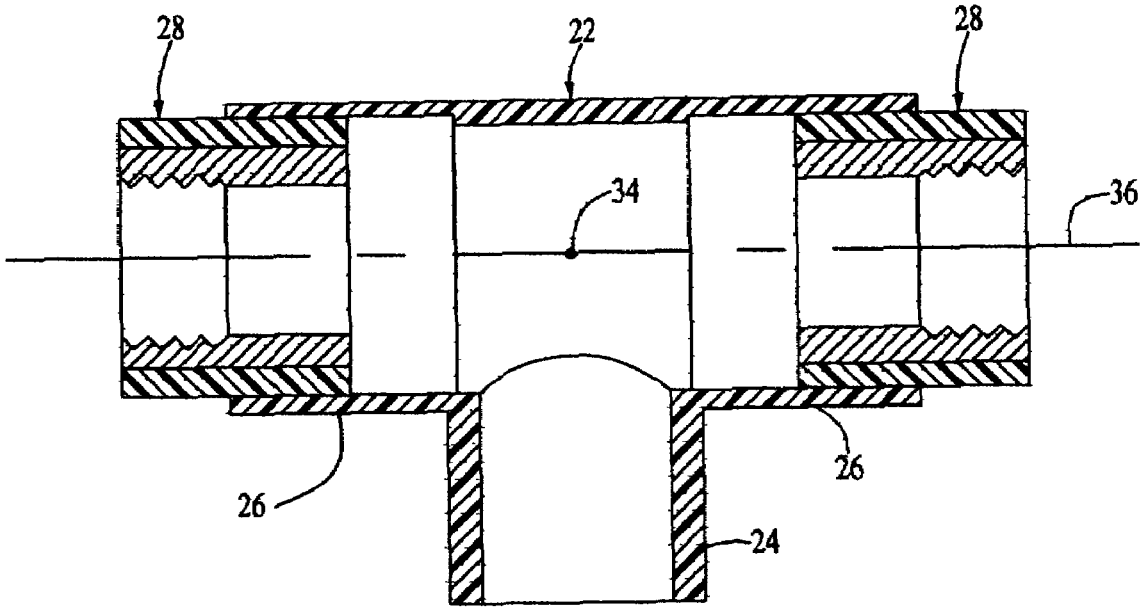
FIG. 18 is a cross-sectional side view illustrating the fire sprinkler piping combination illustrated in FIG. 7, showing both inserts partially disposed within the polymeric piping fitting.

FIG. 18 is contrasted with FIG. 16. FIG. 18 also is a cross-sectional side view of the typical combination of a polymeric pipe fitting 22 and a pair of opposed inserts 28. Unlike that which is illustrated in FIG. 16, in FIG. 18, each of the pair of opposed inserts 28 is only partially disposed within a side branch 26 of the polymeric pipe fitting 22—thereby providing a combination of a polymeric pipe fitting 22 and a pair of inserts 28 which is longer along the common axis 36 than the combination polymeric pipe fitting 22 and two opposed inserts 28 illustrated in FIG. 16.

Figure 19:
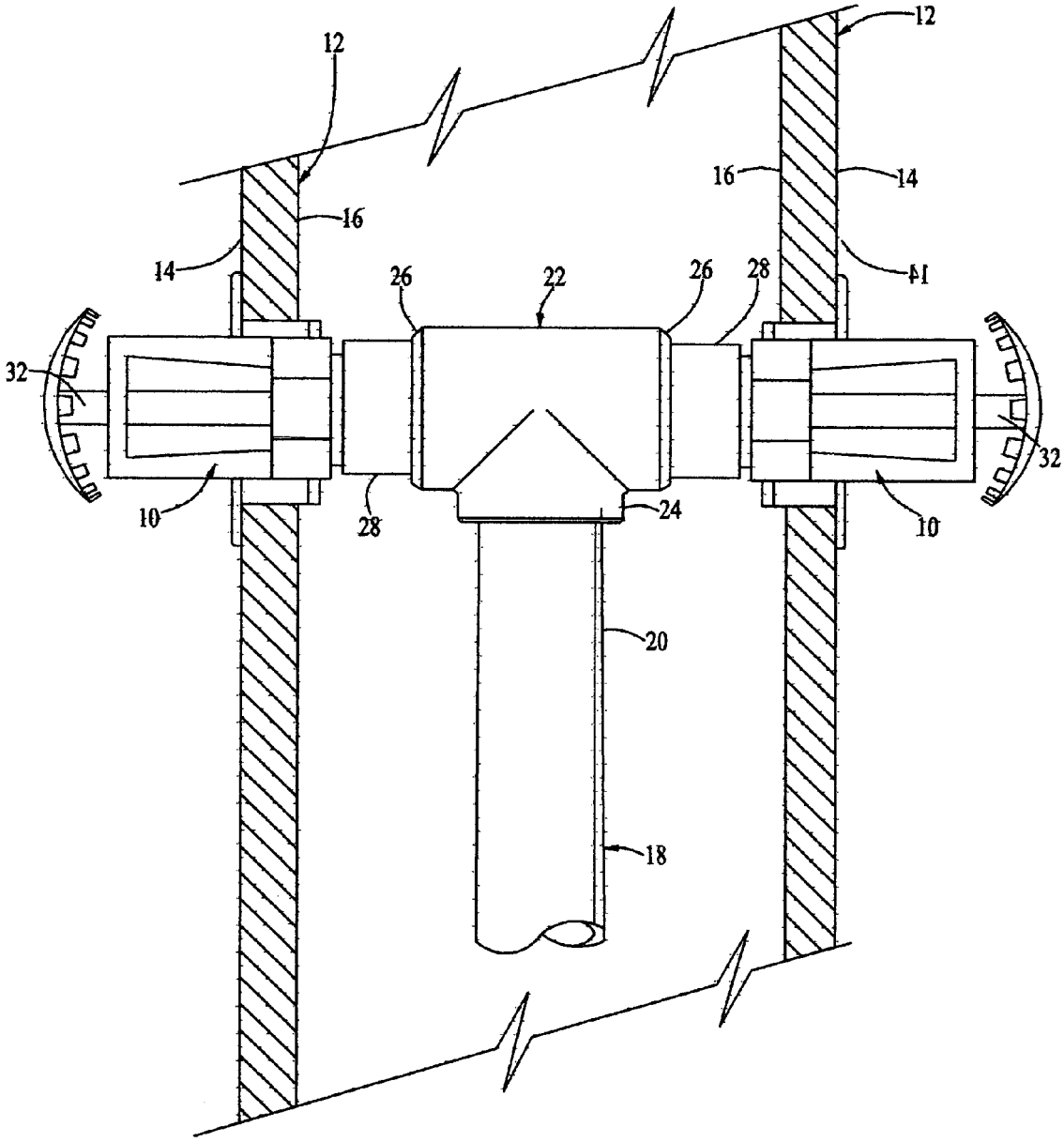
FIG. 19 is a cross-sectional side view illustrating the installation of the fire sprinkler piping combination illustrated in FIG. 18 installed between a pair of parallel, spaced apart walls.

FIG. 19 illustrates a use for the combination polymeric pipe fitting 22 and pair of opposed inserts 28 as illustrated in FIG. 18 to properly install a pair of opposed fire sprinklers 10 on opposite sides of parallel, spaced apart walls 12 wherein the distance between the parallel, spaced apart walls 12 is greater than the distance between the pair of parallel, spaced apart walls 12 in FIG. 17.

The embodiments illustrated in FIGS. 16 and 17 and in FIGS. 18 and 19 illustrate another important advantage of the invention. Prior to the invention, parallel, spaced apart walls having different widths between them would require specifically sized combinations of inserts and polymeric pipe fittings. With the invention, one polymeric pipe fitting in combination with the slidably adjustable pair of inserts is capable of providing a proper combination of polymeric pipe fitting and inserts suitable for use between parallel, spaced apart pairs of walls separated from one another by differing distances.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method of assembling a pair of oppositely disposed fire sprinklers on opposite sides of a pair of spaced apart, parallel walls, each wall having an exterior surface and an interior surface, the method comprising the steps of:

(a) disposing a main water header line between the pair of walls;

(b) disposing at a distal end of the main header line a polymeric pipe fitting having a main branch and at least a first tubular side branch and a second tubular side branch, each of the side branches extending outwardly from a common junction along a common axis, the side branches being co-linear and the main branch being generally perpendicular to the side branches, each of the branches having a distal end opposite from the common junction, the distal ends of each of the side branches having a smooth internal side bore and the distal end of the main branch having a smooth internal main bore to slidably receive a smooth outer end of a length of pipe;

(c) providing at least a pair of internally threaded inserts, each insert having interior threads, an outer side surface, an outer rearward surface and an outer forward surface, each outer forward surface of the pair of inserts being adapted to retain respective fire sprinklers at forward ends of each insert along the common axis, so that when the pipe fitting is disposed between the spaced apart walls, a deflector of each respective sprinkler projects from an exterior surface of one of the walls opposite an interior wall surface exposed to the pipe fitting, the outer side surface of each of the inserts being sized and dimensioned so as to closely match the side bores so as to be capable of being slidably and snugly received into one of the side bores at any of a plurality of locations along the common axis within the side bore;

(d) disposing an insert within the side bore of each side branch of the pipe fitting while adjusting the depth of each insert within a side bore such that the forward surface of each insert is disposed proximate to the interior surface of one of the pair of walls;

(e) retaining each of the at least one pair of internally threaded inserts into a respective side bore; and (f) attaching a fire sprinkler to the interior threads of each insert such that a deflector of each respective sprinkler projects from the exterior surface of each of the spaced apart walls.

2. The method of claim 1 wherein the pair of spaced apart, parallel walls is separated from one another by a distance of between about 3 inches and about 4½ inches.

3. The method of claim 1 wherein the distance between the outer forward surface and the outer rearward surface of each insert is a distance of at least about ¾ inch.

* * * * *